United States Patent [19]

Karr, Jr.

[11] 4,018,663

[45] Apr. 19, 1977

[54] COAL LIQUEFACTION PROCESS

[75] Inventor: Clarence Karr, Jr., Morgantown, W. Va.

[73] Assignee: The United States of America as represented by the United States Energy Research and Development Administration, Washington, D.C.

[22] Filed: Jan. 5, 1976

[21] Appl. No.: 646,706

[52] U.S. Cl. ..... 208/10

[51] Int. Cl.[2] ..... C10G 1/08

[58] Field of Search ..... 208/10

[56] References Cited

UNITED STATES PATENTS

| | | | |
|---|---|---|---|
| 3,527,691 | 9/1970 | Hodgson | 208/10 |
| 3,679,573 | 7/1972 | Johnson | 208/10 |
| 3,840,456 | 10/1974 | Yavorsky et al. | 208/10 |

*Primary Examiner*—Delbert E. Gantz
*Assistant Examiner*—James W. Hellwege
*Attorney, Agent, or Firm*—Dean E. Carlson; David S. Zachry; Irving Barrack

[57] ABSTRACT

An improved coal liquefaction process is provided which enables conversion of a coal-oil slurry to a synthetic crude refinable to produce larger yields of gasoline and diesel oil. The process is characterized by a two-step operation applied to the slurry prior to catalytic desulfurization and hydrogenation in which the slurry undergoes partial hydrogenation to crack and hydrogenate asphaltenes and the partially hydrogenated slurry is filtered to remove minerals prior to subsequent catalytic hydrogenation.

6 Claims, No Drawings

COAL LIQUEFACTION PROCESS

BACKGROUND OF THE INVENTION

The present invention relates to a process for producing liquid fuels from coal. More particularly, it relates to an improved coal liquefaction process for converting coal to a crude petroleum refinable by conventional petroleum refining techniques to produce gasoline and/or diesel fuel.

The consumption of energy in the United States and in other parts of the world has been rising rapidly, while the ratio of petroleum reserves to consumption appears to be declining. This combined with rising costs for manufacture of gasoline and diesel fuel from coal requires improved technology for producing a suitable refinable, crude petroleum substitute from coal.

Conversion of coal to a synthetic petroleum crude oil product requires three basic steps. First, it is necessary to transform solid coal into a liquid form and second to remove its inorganic mineral (i.e., ash) content. In the third place, sulfur, nitrogen, and oxygen removal is required. In addition, for purposes of economy and maximum efficiency, a coal liquefaction process should be capable of transforming asphaltenes into low molecular weight hydrocarbons.

To produce a reproducible petroleum crude requires that the asphaltenes be hydrogenated and converted to low molecular weight aliphatic, naphthenic, and aromatic hydrocarbons. Conversion of coal to liquid form and removal of ash are relatively straightforward operations. Efficient transformation of asphaltenes to lower hydrocarbons is a more difficult problem and represents the rate-controlling step in catalytically-promoted desulfurization, denitrogenization, and thence hydrogenation as well as thermal cracking of coal. The presence of asphaltenes, however, does not prevent conversion of coal into a liquid or readily liquefiable fuel oil useful for firing boilers and the like. A process termed the Synthoil process for converting coal to a low sulfur fuel oil is described in U.S. Pat. No. 3,840,456, the disclosure of which is hereby incorporated by reference. In the Synthoil process a coal-oil slurry is preheated in a preheater and cycled through a fixed catalytic bed reactor at a temperature in the range of 350°–500° C. under a hydrogen pressure ranging from 500–40,000 psig at a velocity substantially above turbulent flow.

A portion of the slurry issuing from the catalyst bed is recovered as the desired low sulfur (less than 0.2 weight percent sulfur) fuel oil product, while the remainder is recycled to the preheater or directly back to the catalytic reactor.

SUMMARY OF THE INVENTION

The present invention represents, and it is the principal object of this invention to provide, a modification of the Synthoil process in a manner which permits production of a crude oil convertible to gasoline and diesel oil by conventional oil refining procedures. According to this invention, conditions are provided in the preheater or in a reactor prior to catalytic desulfurizing and denitrogenation of a coal slurry so as to effect at least partial hydrogenation of the asphaltene and other high molecular weight organic constituents in the slurry. A partial hydropyrolytic treatment prior to and independent of subsequent catalytic desulfurization and catalytically-promoted dehydrogenation permit further hydrogenation to occur under milder temperatures and hydrogen pressures and reduces adverse coking on the catalyst surfaces, thus extending the useful life of the catalysts, especially where the partially hydrogenated coal-oil slurry is filtered to remove mineral residues.

A useful level of hydropyrolytic conversion of asphaltene constituents is accomplished by contacting a coal slurry of the kind described in the previously referred to Synthoil patent with a charge of nominally noncatalytic material in pellet, tablet, or spherical form, such as those typically used for catalyst carriers and having a large surface area of at least 5 square meters per gram and a pore size of at least 0.1 micron at a temperature in the range 400°–450° C. under a hydrogen pressure in the range 1000 to 2000 psig. By nominally noncatalytic, I refer to such materials as alpha alumina, silica, and other chemically inert solids showing appreciably high surface area and large pore size which, of themselves, have no recognized specific catalytic activity as opposed to such materials as gamma-alumina and silica-alumina which do have recognized specific catalytic activity of their own and, in addition, are sometimes used as catalyst supports. Materials with lower surface area or porosity are not effective in the hydropyrolytic conversion step of this invention.

A unique and improved product suitable as a substitute petroleum as an alternate or supplementary petroleum refining feed is obtained when the partially hydrogenated coal-oil slurry is filtered to remove mineral residues and serves as feed for the Synthoil process, operated in the range 350°–400° C., in which the improvement is demonstrated by (in comparison to an unfiltered less altered feed ) larger amounts of coal-derived oil; larger amounts of identifiable coal-derived compounds; larger amounts of coal-derived saturated hydrocarbons, including gaseous members; smaller amounts of asphaltenes (undesirable because of their tendency to coke on catalysts); higher hydrogen-to-carbon ratios of the asphaltenes (which renders them less liable to coke); higher hydrogen-to-carbon ratios of the oils (making them better fuels); larger amounts of alkylated compounds (which make better fuels, and demonstrate less of undesirable dealkylation reactions), and greater reaction of the hydrogen donors in the oil used to make the coal-oil slurry, these being one of the sources of hydrogen for higher hydrogen-to-carbon ratios. The large-pored and high-surface area material makes it possible to form a carbonaceous deposit on the surface, which deposit is believed to promote the specific activity and selectivity required for the desired reactions, without plugging of the pores and loss of surface area.

PREFERRED EMBODIMENT

The advantages of a pre- or partial- hydrogenation and filtration of the oil-slurried coal prior to catalytic hydrogenation will be demonstrated in the following representative embodiment.

Coal-oil slurries were made up with 1 part by weight of coal (Pittsburgh seam, Ireland mine, 33.06 weight percent volatile matter, 0.72 weight percent moisture, 19.51 weight percent high-temperature ash) and 2 parts of hydrogenated Reilly tar oil. This hydrogenated oil was prepared in a stirred batch reactor with hydrogen gas at 390° C. and 1,800 psig for 3 hours, using about 1,800 ml oil and about 32 g presulfided cobalt molybdate on silica-promoted alumina ⅛-inch pellets in baskets attached to the stirrer. The catalyst was presulfided in situ with a flow of 10–15 percent hydrogen sulfide in hydrogen 3–4 liters per hour per 100 g catalyst for 1.5 hours at 400° C. and atmospheric pressure. Gas chromatographic analysis showed about 20 percent identifiable hydroaromatics, or hydrogen donors, in the hydrogenated oil, compared to none in the original oil. The identities of these are indicated in Table VI to be discussed later.

These slurries were examined for their behavior with two different kinds of material in the partial hydrogenation reaction, namely a vitrified ceramic, represented by Norton "Denstone 57" catalyst bed support, consisting of ¼-inch balls with a surface area of about 0.01 $m^2/g$ and a very low apparent porosity of about 1.0 percent, and alpha-alumina, represented by Girdler catalyst carrier T-375 obtained from Girdler Chemical, Inc., Louisville, Kentucky, consisting of ⅛-inch pellets with a surface area of about 5.3 $m^2/g$, having a pore diameter in the range 0.06 to 0.8 microns. A series of runs was made in a stirred batch reactor, using 36.15 g of "Denstone" or alpha-alumina in baskets attached to the stirrer, and about 900 g slurry at 450° C. and 1,800 psig for 3 hours, or about 1,800 g slurry at 430° C. and 1,500 psig for 3 hours, the reactor being brought up to the desired pressure with hydrogen gas. Air was flushed from the system with nitrogen gas and nitrogen purged from the system with hydrogen gas before partial pressurizing, heating and then any final pressurizing. As hydrogen was consumed, the pressure was maintained with additional hydrogen.

Half of each first-step product from all runs was filtered to remove mineral residue, and the filtered and unfiltered portions were then subjected to treatment with a typical hydrogenation catalyst suitable for a second-step reactor, namely, the same catalyst used to prepare the hydrogenated tar oil (Harshaw CoMo-0402 T ⅛) obtained from the Harshaw Chemical Company, Division of Kewanee Oil Company, Cleveland, Oh. In practice, the mineral residue-free second-step product, or a distillate cut or residue, or a blend of mineral residue-free first and second step products, should be used to make up the slurry. Therefore, the second-step catalyst was used to prepare the hydrogenated tar oil, as this catalyst would be the main source of hydrogen donors in the process. The second step run conditions for all 8 runs were identical, namely, 1,500 psig (obtained with hydrogen gas) at 380° C. for 1 hour in a stirred reactor, using about 200 g of the partially hydrogenated oil-coal slurry as feed and 0.4 g presulfided cobalt molybdate on silica-promoted alumina. The quantity of catalyst was chosen to approximate 500 hours operation at a liquid hourly space velocity of one in a fixed bed process.

The products were subjected to the following analyses, taking care to insure that each sample was treated in the same manner: (1) solvent extraction to recover benzene insolubles, which contain various proportions of unreacted coal, mineral residues, and insoluble asphaltic material, asphaltenes (benzene-soluble, cyclohexane-insoluble), and oils (cyclohexane-soluble); (2) liquid elution chromatography of the oils from activated alumina with cyclohexane and benzene (to remove colored resins); (3) gas chromatography of the cleaned oil to identify and quantify individual compounds; (4) elemental analysis for determination of the atomic hydrogen-to-carbon ratio in various samples; and (5) gas chromatographic analysis of the gaseous products for the amounts of the individual hydrocarbons.

The results of the solvent extraction analysis of the products from two-step coal liquefaction are summarized for all 8 runs in Table I, with the data for the paired "Denstone" and alpha-alumina first-step reactor materials placed together for ease of comparison.

TABLE I

Solvent Extraction Analysis of Product From Two-Step Coal Liquefaction in Stirred Batch Reactor

| | Weight Percent | | | | | | | |
|---|---|---|---|---|---|---|---|---|
| First-step run-conditions[1] | 1,800 psig, 450° C., 3 hrs | | | | 1,500 psig, 430° C., 3 hrs. | | | |
| Mineral residue | Not filtered between steps | | Filtered | | Not filtered between steps | | Filtered | |
| First-step reactor material | Denstone | Alpha-Alumina | Denstone | Alpha-Alumina | Denstone | Alpha-Alumina | Denstone | Alpha-Alumina |
| Fraction | | | | | | | | |
| Benzene insolubles (inorganic + other insoluble coal ingredients) | 11.3 | 11.5 | 9.2 | 10.5 | 12.3 | 14.4 | 15.0 | 18.6 |
| Asphaltenes (benzene-soluble, cyclohexane-insoluble) | 9.3 | 5.2 | 26.1 | 11.6 | 16.3 | 14.4 | 26.0 | 16.5 |
| Oils[2] (cyclohexane-soluble) | 79.4 | 83.3 | 64.7 | 77.9 | 71.4 | 71.2 | 59.0 | 64.9 |

[1]Second-step run conditions of all eight runs: 1,500 psig, 380° C., 1 hr., presulfided cobalt-molybdenum on silica-promoted alumina (used for desulfurization and denitrogenation).

[2]Includes the bulk of the oil used to make up the coal-oil slurry.

As shown in Table I, the hydroliquefaction of the coal in the first step, as reflected by the yields of asphaltenes obtained by the use of alpha-alumina, was significantly lower, down to about one-half the quantity obtained with the vitrified ceramic. In the one instance in which the yields were close, the atomic hydrogen-to-carbon ratio was substantially higher for the alpha-alumina derived asphaltene, as shown in Table II.

TABLE II

| Elemental Analysis of Two-Step Products, Using Unfiltered Feed For Second step | Atomic H/C | | | |
|---|---|---|---|---|
| First-Step Run Conditions: | 1,800 psig, | 450° C. | 1,500 psig, | 430° C. |
| First-Step Reactor Material: | Denstone | Alpha-Alumina | Denstone | Alpha-Alumina |
| Benzene insolubles | 0.62 | 0.65 | 0.72 | 0.73 |
| Asphaltenes | 0.64 | 0.70 | 0.75 | 0.78 |
| Oils | 0.95 | 0.94 | 0.95 | 0.99 |

Under both of the first-step run conditions, with regard to pressure and temperature, the atomic hydrogen-to-carbon ratios for the asphaltenes were clearly higher using alpha-alumina, as shown in Table II. In one instance the atomic H/C for the oil derived in the presence of alpha-alumina was distinctly higher; in the other, the two oils had nearly identical values of atomic H/C, but the yield of oil was greater with alpha-alumina, as shown in Table I, demonstrating a higher total hydrogen gain for the alpha-alumina derived oil.

Part of the oils comes directly from the unreacted compounds in the oil used to make the coal-oil slurry, while the rest comes from hydroliquefaction of the coal, including the aphaltene components. Assuming that the lowest oil yield (59.0 weight percent) does not come from coal, it can be seen that in most instances the amount of oils was increased from 20 percent to as much as 3-fold by using alpha-alumina instead of the low porosity vitrified ceramic. The exception is due to the presence of mineral residue at the milder operating conditions, in which instance these residues have an overriding and equalizing effect, as mentioned later. However, even in the case where the oil yields were essentially the same, the atomic hydrogen-to-carbon ratio for the alpha-alumina derived oil was much higher, as shown in Table II, demonstrating a higher total hydrogen gain for the alpha-alumina derived oil.

In line with the larger amounts of coal-derived oil, using the more active alpha-alumina, larger amounts of identifiable coal-derived compounds were obtained, as shown in Table III.

TABLE III

| Coal-Derived Compounds in Two-Step Product, Using Filtered Feed For Second Step | Weight Percent[1] | | | |
|---|---|---|---|---|
| First-Step Run Conditions: | 1,800 psig, | 450° C. | 1,500 psig, | 430° C. |
| First-Step Reactor Material: | Denstone | Alpha-Alumina | Denstone | Alpha-Alumina |
| 3,4-Benzophenanthrene | 0.10 | 0.14 | 0.18 | 0.37 |
| Benzo(m, n, o) fluoranthene | 0.09 | 0.11 | 0.05 | 0.16 |
| 2,3-Benzofluoranthene | 0.19 | 0.53 | 0.29 | 0.40 |
| Benzo (a) and (e) pyrene | 0.11 | 0.17 | 0.20 | 0.25 |
| Total | 0.49 | 0.95 | 0.72 | 1.18 |
| Percent Increase | 93.8 | | 63.9 | |

[1]Calculated on the basis of the oil in the coal/oil slurry. For coal basis, multiply by 2.

The five compounds in Table III are all polycyclic aromatic hydrocarbons which were not detectable in the hydrogenated tar oil, and therefore result from the hydropyrolytic treatment of the coal. The first one has four rings and the others have five rings. The slightly lower concentrations at the higher temperatures and pressures may be explained by the dilution with a little more of other coal-derived hydrogenated compounds.

The higher activity of the large-pored, high surface area alpha-alumina for producing hydrocarbons was also demonstrated by the gaseous hydrocarbons collected during the first-step runs. The number of standard cubic feet of methane, ethane, propane, and butanes per pound of coal was in each instance greater for each hydrocarbon compound when using alpha-alumina, as shown in Table IV.

TABLE IV

| First-Step Hydrocarbon Gas Yields | Scf/lb Coal | | | |
|---|---|---|---|---|
| Run Conditions: | 1,800 psig, | 450° C. | 1,500 psig, | 430° C. |
| Reactor Material: | Denstone | Alpha-Alumina | Denstone | Alpha-Alumina |
| Methane | 1.645 | 1.890 | 0.835 | 0.985 |
| Ethane | 0.619 | 0.810 | 0.246 | 0.308 |
| Propane | 0.274 | 0.449 | 0.131 | 0.188 |
| Butanes | 0.043 | 0.070 | 0.022 | 0.025 |
| Total | 2.581 | 3.219 | 1.234 | 1.506 |
| Percent Increase | 24.7 | | 22.2 | |

It will be noted that the yields of hydrocarbon gas are greater at 450° C. than at 430° C., because it is at the higher temperature that bituminous coals undergo more rapid increase in thermal decomposition. That the greater yields of hydrocarbon gas with alpha-alumina are not due to greater dealkylation of alkylated polycyclics in the oil, is shown in Table V.

TABLE V

| Alkylated Compounds in Two-Step Product, Using Filtered Feed for Second Step | Weight Percent | | | |
|---|---|---|---|---|
| First-Step Run Conditions: | 1,800 psig, | 450° C. | 1,500 psig, | 430° C. |
| First-Step Reactor Material: | Denstone | Alpha-Alumina | Denstone | Alpha-Alumina |
| Methyl-, Dimethyl-, and Ethylnaphthalenes | 11.58 | 14.04 | 9.95 | 9.73 |
| Methyldibenzofurans | 2.46 | 2.13 | 2.22 | 3.01 |
| Methylfluorenes | 1.07 | 1.16 | 0.85 | 1.40 |

TABLE V-continued

| Alkylated Compounds in Two-Step Product, Using Filtered Feed for Second Step | Weight Percent | | | |
|---|---|---|---|---|
| First-Step Run Conditions: | 1,800 psig, 450° C. | | 1,500 psig, 430° C. | |
| First-Step Reactor Material: | Denstone | Alpha-Alumina | Denstone | Alpha-Alumina |
| Methylbiphenyls | 0.43 | 0.44 | 0.32 | 0.37 |
| Methylphenanthrenes | 2.60 | 2.92 | 2.79 | 2.93 |
| Methylpyrenes | 0.45 | 0.50 | 0.35 | 0.54 |
| Total | 18.59 | 21.19 | 16.48 | 17.98 |
| Percent increase | 14.0 | | 9.1 | |

The total amounts of six important classes of alkylated polycyclic aromatics were greater for the products obtained using alpha-alumina, as shown in Table V, under the first-step conditions, with regard to pressure and temperature. Larger amounts were obtained with both first-step materials at the more rigorous run conditions of hydrogen pressure and temperature due to greater reaction of the coal, but the percent increase for alpha-alumina was considerably greater under the more rigorous conditions.

The identities and amounts of the six identifiable hydroaromatics, or hydrogen donors, in the hydrogenated tar oil used to make up the slurry are shown in Table VI.

TABLE VI

| Gas Chromatography of Hydrogen Donors in Hydrogenated Tar Oil for Slurry Before and After Reaction With Coal: Analysis of First-Step Products | Weight Percent | | | | | |
|---|---|---|---|---|---|---|
| | | After reaction at 1,800 psig 450° C. on | | | After reaction at 1,500 psig, 430° C. on | |
| Compound | Lot A Before Reaction | Denstone | Alpha-Alumina | Lot B Before Reaction | Denstone | Alpha-Alumina |
| Indan | 1.33 | 1.51 | 1.25 | 1.09 | 0.83 | 0.77 |
| Tetralin | 9.55 | 6.61 | 4.62 | 9.58 | 4.83 | 4.72 |
| Dihydrophenanthrene | 2.71 | 1.32 | 1.11 | 3.19 | 0.75 | 0.54 |
| Tetrahydrophenanthrene | 3.33 | 1.18 | 1.12 | 2.62 | 1.37 | 1.05 |
| Tetrahydropyrene | 2.33 | 0.59 | 0.84 | 2.82 | 0.83 | 0.71 |
| Dihydropyrene | 0.96 | 0.60 | 0.69 | 0.95 | 0.29 | 0.32 |
| Total | 20.21 | 11.81 | 9.63 | 20.25 | 8.90 | 8.11 |
| Percent reacted | | 41.6 | 52.3 | | 56.0 | 60.0 |

Analysis of the oil resulting from the four different first-step products showed a substantial consumption of these hydrogen donors. Under both of the first-step run conditions, with regard to pressure and temperature, there was a considerably larger consumption of hydrogen donors in the presence of alpha-alumina. Table VI also shows greater consumption of hydrogen donors at the milder operating conditions, just as Table II shows higher atomic H/C for the products obtained at the milder conditions.

The much greater surface area and pore volume of the alpha-alumina compared to the vitrified ceramic apparently offers more surface for the hydrogen donors to react. Examination of the spent materials visually, and by scanning electron microscopy, showed that the actual surface for reaction was a black, carbonaceous deposit which not only covered the exterior of the ceramic balls, but covered pore surfaces throughout the entire interior of the alpha-alumina pellets.

Viewing the herein-disclosed process as a whole, it is seen that a two-step process involving an initial hydropyrolytic treatment of a coal-oil slurry which employs material having a suitably high surface area and large pore size to promote the hydropyrolytic reaction followed by catalytic cracking of the filtered partially hydrogenated polycyclic aromatic compounds and asphaltenes, results in the production of a cyclohexane-soluble product containing a high aliphatic component as well as a high content of alkylated hydrocarbons in the gasoline range. Table I shows the value of a high surface area, large-pored material in reducing the amount of asphaltenes.

It should be noted that the data of Table I can be interpreted to mean that the presence of mineral residues in the second step (where the unfiltered slurry having undergone hydropyrolytic treatment in the first step is fed to the second or catalytic cracking step) provides improved results in terms of decreased yields of asphaltenes. Thus, the unfiltered Denstone asphaltenes yield was 9.3 as compared to 26.1 for the unfiltered case, and 5.2 for the unfiltered case as compared to 11.6 for the filtered case where alpha-alumina was used. This apparent advantage for the unfiltered case is, however, outweighed by several disadvantages. For example, while it is generally recognized that the mineral residues in coal are catalytically active, their activity is highly unpredictable and irreproducible, varying with process conditions and with the mineral content of the coal feed. Secondly, some metals of the mineral residue can act as poisons for catalysts normally used in the second step. In addition, the mineral residues present a serious operational problem when the second step is conducted in a fixed bed catalytic reactor. As the density and viscosity of the cyclohexane-soluble oil decreases and takes on a more aliphatic character, it loses it ability to serve as a carrier for the heavier mineral residue. The result is that the mineral residues deposit in and on the catalyst packing to reduce the specificity and activity of the catalysts, requiring that the fixed bed be recharged with fresh catalyst after only a relatively short run time. With this explanation in mind, the basic inventive concept of this proposed two-step process may be viewed as founded on the recognition that a prehydropyrolytic treatment of a coal-oil slurry employing a hydrogenation promoting surface can effectively reduce the amount of asphaltenes and other high molecular weight unsaturated compounds separately and apart from a second step involving catalytic hydrogenation. By filtering the hydropyrolytically treated slurry to remove mineral residues, and passing the filtered hydropyrolytically treated slurry to catalytic hydrogenation, the operational difficulties previously referred to are averted or eliminated especially where the overall process is directed to producing a highly aliphatic oil suitable to serve as a petroleum substitute feed for conversion by standard oil refining techniques to gasoline and diesel oil fractions. In effect, whatever chemical catalytic (principally hydrogenating) activity or function which the mineral residue may have provided is now taken up by the high surface area, large-pored material which remains in the first step; and by filtering the mineral content between the first and second reactors, a hydropyrolytically treated feed of more uniform chemical character is provided for catalytic hydrogenation in the second step under conditions which minimize catalyst poisoning and reduce physical burdens which occur where the coal-oil slurry is fed directly into the catalytic hydrogenation reactor without previous hydropyrolytic treatment and filtration to effect removal of mineral residues.

The two-step process herein disclosed is practiced by cycling a coal-oil slurry under a pressure of hydrogen between a first reactor containing, in a typical fashion, a packed bed of pellets having a large enough surface and pore size to promote hydrogenation of the polycyclic components including asphaltenes in the coal. Among the materials useful for this purpose are alpha-alumina, silica, and other chemically inert substances in pellet form having a surface area of at least 1–5 $m^2$/gram and a pore size sufficiently large so that they are not clogged by the high molecular weight components, particularly the asphaltenes. A material having a pore size in the range of no less than about 0.05 micron and up to about 0.5 micron is suitable for this purpose. Conditions of hydrogen pressure and temperature in the first reactor should be maintained so as to promote maximum cracking of high molecular weight components and hydrogenation of points of unsaturation. This is achieved at a hydrogen pressure in the range 1000–2000 psig at a temperature in the range 375°–450° C. The minimal temperature is dictated by the requirement of obtaining a reasonable rapid dissolution of the soluble organic components of the coal. Operation at temperatures much above 450° C. results in considerable adverse carbonization which affects the degree of hydrogenation. The high surface area and pore volume of such materials as alpha-alumina as compared to a vitrified ceramic, such as Denstone, apparently offers more surface area for the hydrogen donor material in the slurry to react at center or points of unsaturation along the hydrocarbon chain. Examination of the spent materials visually and by scanning electron microscopy showed the actual surface for reaction was a black carbonaceous layer which covered the exterior surface and internal pore volume of the alpha-alumina pellets. As shown by the data in Table IV, first-step yield of lower hydrocarbons (1 to 4 carbon atoms per molecule ) is greater at 450° C. and 1,800 psig than at 430° C. and 1,500 psig. However, no apparent advantage is realized in going to any higher temperature, for the higher yields will begin to diminish and be counterbalanced by an increased rate of adverse carbonization. Table V shows that the increased yields of lower gaseous hydrocarbons do not occur at the expense of alkylated products in the oil produced from the second step.

The design and operation of the stirred batch reactor for the first step was such as to allow an estimation of one hour equivalent run time for a fixed bed, flow-through reactor. Thus, the preferred liquid hourly space velocity for the hydropyrolytic treatment is ~1.0.

The filtered oil resulting from the first-step hydropyrolytic treatment serves as feed for the catalytic hydrogenation occurring in the second step. In the second step a reactor is charged as a fixed or ebullient bed with standard commercially available catalysts functioning to desulfurize, denitrogenize, and hydrogenate the dissolved coal component. Typical of such catalysts are Harshaw CoMo-0402 T ⅛ inch cobalt molybdate catalyst supported on silica alumina; Harshaw HT-100 E ⅛ inch nickel molybdenum catalyst supported on alumina; and Harshaw Ni-4301 E ½ inch nickel tungsten catalysts on silica alumina.

Second-step temperature and hydrogen pressure conditions in the catalytic reactor are similar to those used in the first-step hydropyrolytic treatment and are selected to maximize production of a cyclohexane-soluble fraction consisting principally of straight and branched chain aliphatics containing from 1–8 carbon atoms and hydrogenated polycyclic compounds such as those listed in Table VI. In general terms, maximum desired cracking, napthenation, and hydrogenation will be effected at a hydrogen pressure in the range 1000–2000 psig at an operating temperature in the range 300°–400° C. Higher hydrogen pressures are not required for production of the desired compounds because the hydropyrolytic pretreatment and mineral residue removal allow maximum catalytic activity in the second step. Higher temperatures result in excessive hydrocracking with reduced yields of liquid product.

As seen from the data in Table I, filtered feed from the first step is converted in the second step at 1,500 psig and 380° C. to a liquid product containing from 11.6 to 16.5 percent asphaltenes. By comparison, unfiltered coal-oil slurries to be fed directly to a fixed bed catalytic reactor without a prior hydropyrolytic treatment typically contain in excess of 20% asphaltenes, with lower hydrogen-to-carbon ratios, lower percentage of alkylated hydrocarbons to produce a viscous liquid which may be solid at room temperature. In contrast, the liquid product resulting from the filtered hydropyrolytically treated slurry from the first step is converted in the second step to a low surfur and nitrogen oil which is readily refinable by standard oil refinery techniques to produce large yields of diesel oil and gasoline.

Filtration, centrifugation, and hydrocloning (with cyclones designed for liquids) have been used to separate mineral residues successfully. Magnetic separation is also a particularly useful mode of separation.

What is claimed is:

1. An improved liquefaction process comprising passing a liquid coal slurry containing suspended materials under a pressure of hydrogen of 1000–2000 psig and at a temperature in the range 400° to 450° C. through a first reactor containing a charge of porous inert inorganic nominally non-catalytic material having a sufficiently high pore size and surface area so as to promote at least partial hydrogenation of asphaltenes, passing the partially hydrogenated hydrogen-pressurized slurry to a second reactor to contact a charge of hydrogenation catalyst at a temperature in the range 350° to 400° C. and removing a liquid fuel from said second reactor as product.

2. The process of claim 1 in which the partially hydrogenated coal slurry issuing from the first reactor is treated to remove mineral residues.

3. The method according to claim 1 in which the inorganic material charge in the first reactor is a material selected from the group consisting of alpha alumina, silica, and similar chemically inert solids, with high surface area and large pore size.

4. The process of claim 1 in which a portion of the liquid product issuing from the second reactor is recycled back to the said first or second reactor.

5. The method according to claim 1 in which the second reactor contains a desulfurization and denitrogenization catalyst.

6. The method according to claim 1 in which the porous inertnominally non-catalytic material has a pore size in the range 0.05 to 0.5 microns and a surface area in the range 1–5 square meters per gram.

* * * * *